United States Patent [19]

Evans

[11] 3,982,607

[45] Sept. 28, 1976

[54] LOUDSPEAKER CABINET HAVING AN INTEGRALLY CONSTRUCTED HORN

[76] Inventor: Arnold D. Evans, 17500 Wolcott Lane, Marana, Ariz. 85238

[22] Filed: Jan. 28, 1975

[21] Appl. No.: 544,763

[52] U.S. Cl. ..... 181/152; 181/DIG. 1; 181/151; 181/180

[51] Int. Cl.[2] ..... H05K 5/00; G10K 11/00

[58] Field of Search ..... 181/152, 151, 148, 149, 181/DIG. 1; 179/189 F, 115.5 H, 115.5 R

[56] References Cited

UNITED STATES PATENTS

| | | | |
|---|---|---|---|
| 1,866,921 | 7/1932 | Black | 181/160 |
| 2,815,087 | 12/1957 | Delort | 181/152 |
| 3,059,720 | 10/1962 | Matsuoka | 181/151 |
| 3,720,285 | 3/1973 | Russell et al. | 181/151 |

FOREIGN PATENTS OR APPLICATIONS

| | | | |
|---|---|---|---|
| 697,869 | 11/1964 | Canada | 181/167 |
| 1,326,414 | 4/1963 | France | 181/167 |

*Primary Examiner*—Stephen J. Tomsky
*Attorney, Agent, or Firm*—Cahill, Sutton & Thomas

[57] ABSTRACT

An integrally formed cabinet for a loudspeaker having a preformed horn for dispersing acoustic energy with minimum distortion.

11 Claims, 7 Drawing Figures

LOUDSPEAKER CABINET HAVING AN INTEGRALLY CONSTRUCTED HORN

The present invention relates to loudspeaker cabinets and, more particularly, to cabinets having integrally formed molded horns disposed therein.

Audiophiles, professional recording concerns and entertainers depend to a great extent for their enjoyment and remuneration upon the accuracy with which their musical compositions are reproduced by electromechanical devices. The emphasis has been and will continue to be upon the transference of electrical energy into acoustic energy with a minimum of distortion whenever and wherever electronic amplification is employed. Not only must the electronic circuitry be distortion free but the mechanical components generating and propagating the sound waves must be capable of doing so with utmost accuracy.

For the above reasons, many different types of enclosures have been developed for loudspeakers. Moreover, much experimentation has been done in an attempt to determine the most perfect and distortion free horn, whether of straight, folded, or circular configuration. Within these configurations, hypex, conical exponential and parabolic flares have been designed to maximize the efficiency of the horns. A more definitive description of loudspeaker cabinetry and horn construction may be found within pages 1079–1161 of the *Audio Cyclopedia* by Howard M. Tremaine, Howard W. Sams & Company, 1969.

With the advent of synthetic materials which have audible sound absorbing qualities, many loudspeaker enclosures have been developed and patented in this country. The following United States patents are illustrative of such enclosures, which enclosures tend to increase the efficiency and minimize the distortion in converting electrical energy into acoustic energy: U.S. Pat. Nos. 2,775,309, 2,926,740, 2,978,060, 3,059,720, 3,177,301, 3,293,378, 3,299,206, 3,617,654, 3,720,285, 3,780,232, and 3,821,490.

The emphasis within the prior art has been primarily directed to the development of resonating chambers adjacent the rear surface of the loudspeaker diaphragm or toward the channeling of the acoustic energy generated by rearward movement of the diaphragm to render it in phase with the acoustic energy generated by the forward movement of the diaphragm. Additional refinements associated with various ranges of audio frequencies and cross-over networks have also been produced. Once the acoustic energy has been generated by the diaphragm, variously shaped free standing horns have been employed to disperse the acoustic energy with minimum distortion within dispersion angles located in both the vertical and horizontal planes. These horns, whether used singly or in arrays, are normally free standing and hence subject to vibration. Moreover, they are relatively expensive to manufacture and subject to damage during transportation.

It is therefore a primary object of the present invention to provide an enclosure for a loudspeaker having an integrally formed resonant chamber and horn.

Another object of the present invention is to provide an inexpensively manufactured molded horn for dispersing the acoustic energy of a loudspeaker.

Yet another object of the present invention is to provide a vibration damped horn for a loudspeaker within an enclosure.

Still another object of the present invention is to provide a loudspeaker enclosure which can accommodate a horn of any cross-sectional configuration and rate of flare.

A further object of the present invention is to provide a loudspeaker enclosure having a plurality of horns, each of which disperses the acoustic energy from a single loudspeaker.

A still further object of the present invention is to provide a transportable enclosure for an assembled loudspeaker and horn.

A yet further object of the present invention is to provide a loudspeaker enclosure formed of synthetic material of various densities to disperse essentially distortion free acoustic energy.

These and other objects of the present invention will become apparent to those skilled in the art as the description thereof proceeds.

The present invention will be described with greater specificity and clarity with reference to the following figures, in which.

For the sake of brevity and clarity in describing the present invention to those skilled in the art, the figures have been essentially limited to cross-sectional views of the various embodiments. It is to be understood that the overall configurations of the various components are either as described below or are readily apparent to those knowledgeable in the art.

Figure 1:
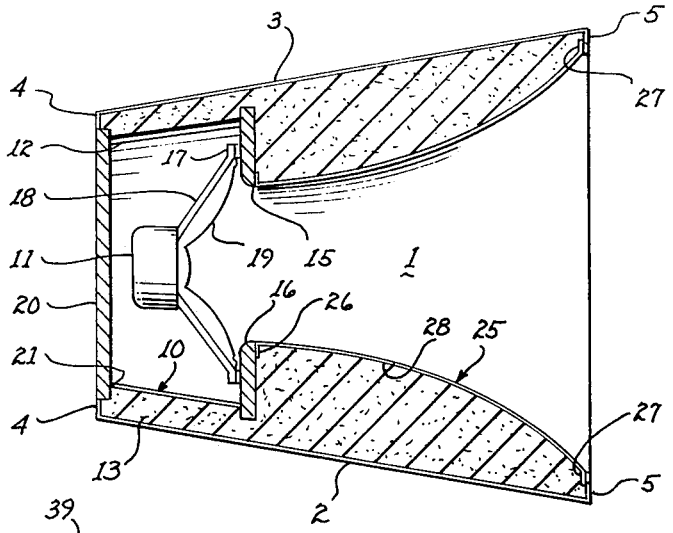
FIG. 1 illustrates a cross-sectional view of a speaker enclosure incorporating the present invention.

Referring to FIG. 1, the exterior dimensions of enclosure 1 are formed by lateral sides 2 and 3 and rear and front surfaces 4 and 5, respectively. These sides and ends serve primarily as a rigid envelope to house and protect the components disposed therein. Hence, they may be formed of multi-ply plywood, plastic, reinforced plastic such as fiberglass, etc. Moreover, the boundaries of the sides and ends may define a truncated pyramid as illustrated, a square, rectangle or other physically manageable configuration of any practical size.

A recess 10 is disposed in proximity to the rear of enclosure 1 for housing a loudspeaker 11 such as the low frequency driver illustrated. The perimeter of recess 10 may be defined by a circularly or rectangularly shaped shroud 12. The shroud is positioned within the rear portion of enclosure 1 by means of low density foam 13 (i.e. two pound foam) disposed intermediate the shroud and the rear portions of the enclosure lateral side. Loudspeaker 11 is mounted on and supported by an annular plate 15, which plate extends radially inwardly from shroud 12. The inner edge 16 of plate 15 is dimensioned so as to maintain a supporting surface for the periphery 17 of cone 18, but it should terminate inwardly thereof so as not to impede or impinge upon the acoustic energy radiated from the loudspeaker diaphragm 19. Plate 15 is positionally supported within enclosure 1 by foam 13 extending inwardly from lateral sides 2 and 3. A removable cover 20 extends across the rear of enclosure 1 in general overlapping alignment with recess 10 to provide access to loudspeaker 11 when necessary. Cover 20 is mounted within a seat 21 extending about the rear periphery of recess 10 to assure an air tight seal intermediate the recess and the exterior of enclosure 1.

A horn 25 extends forwardly of plate 15 to front end 5 of enclosure 1. The horn is fixedly attached to plate 15 by means such as a radially extending flange 26. A similar flange 27 extends radially outwardly from the front part of horn 25 for rigid attachment with front end 5. The outer surface of horn 25 is supported throughout its length by means of foam 13 impinging thereupon. The shape of horn 25, although shown as an essentially exponential horn, may, of course, be alternatively hypex, conical or parabolic, depending upon the type and nature of performance intended by the audio engineer.

As illustrated in FIG. 1, plate 15 and loudspeaker diaphragm 19, in combination, establish an air seal intermediate the air spaces defined by recess 10 and horn 25. Similar air seals are established in the embodiments of the present invention illustrated in FIGS. 2, 3, 5 and 6.

With the present state of development of fiberglass technology and the fact that compound curvature forms when reproduced in fiberglass are particularly rigid, strongly suggests that horn 25 be formed of fiberglass. Despite the apparent rigidity of a compound curvature horn and regardless of the inherent strength of the material itself, some vibration may occur. Such vibration necessarily produces some distortion of the acoustic energy generated by the diaphragm 19 of loudspeaker 11. To minimize vibration, particularly in the low frequencies, foam 13 is disposed intermediate horn 25 and the lateral sides of enclosure 1. The foam, being essentially non-resilient, tends to dampen and inhibit all vibration of horn 25. Thus, the quality of sound emanating from horn 25 is essentially a function of the flare of the horn and the acoustic reproduction capability of loudspeaker 11.

In the prior art, the concept of minimizing distortion was essentially predicated upon the use of thick density materials to inhibit undesired vibration. The results produced were in many cases quite satisfactory. However, the resulting weight of the enclosures essentially precluded them from being transportable, except through Herculean efforts. In contradistinction, the present invention can be manufactured of thin walled lightweight exterior surface materials of sufficient strength and rigidity to prevent distortion during transportation and the operative elements, recess 10, plate 15 and horn 25, can also be of lightweight thin walled materials in that foam 13 not only maintains them in appropriate spatial relationships but also very effectively inhibits acoustically generated vibration and the resulting distortion of the emanating sound. Hence, the present invention is particularly adaptable for traveling troupes in that they need no longer rely upon the existing electronic amplification equipment at the various locations of their performances, but can transport their own high quality equipment wherever they go.

Figure 2:
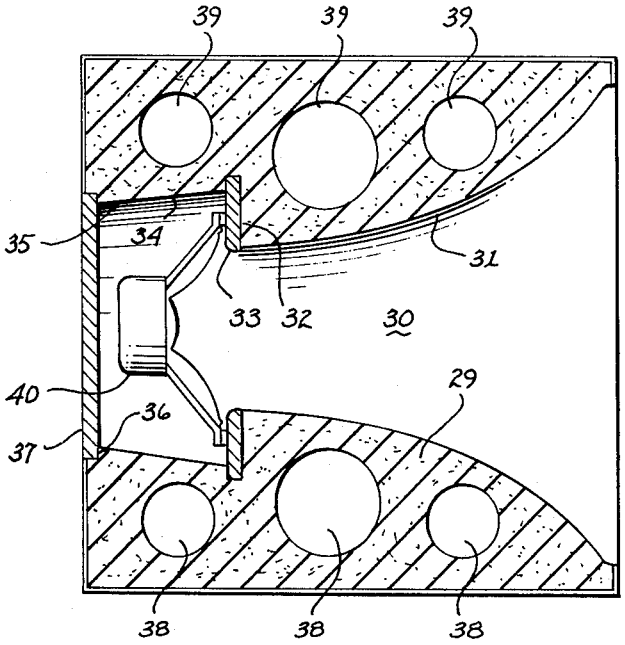
FIG. 2 illustrates a variant of the speaker enclosure shown in FIG. 1.

Referring to FIG. 2 there is shown a variant of the present invention, as described in FIG. 1. Presently, there is available synthetic foam material which, when molded, produces a thick skin in proximity to the surfaces of the mold. When such foam is used, it may be possible to dispense with both the shroud 12 and the horn 25 as shown in FIG. 1. Instead, a form defining the exterior dimensions of enclosure 30 is constructed. A male plug, or a plurality of plugs are disposed within the form such that a part of the plug or one plug defines the dimensions of horn 31; another part of the plug or a separate plug defines the surfaces 32 supporting plate 33; and, a third part of the plug or a third plug defines the lateral boundary 34 of recess 35; a section of the third part of the plug or the section of the third plug can also be employed to define seat 36 for cover 37. The foam 29 is then poured or inserted within the form and allowed to cure. After curing, the foam will have acquired surfaces duplicating the form and the plug(s), which surfaces are sufficiently strong to withstand normal use. There is presently available foam in the range of 16 to 24 pound density which, when cured, forms a very hard surface. Such foam could be used as an add-on to the outer surfaces of enclosure 30 or formed integrally with enclosure 30, should additional protection be required.

It has also been learned that lightening cavities 38 and 39 can be disposed within foam 29 to lighten the weight of the enclosure 30 without deleteriously affecting the damping capability of the foam and without distorting the carefully computed convolution of molded horn 31.

After the basic foam structure has been molded, plate 33 may be added and secured thereto for receiving loudspeaker 40. Similarly, cover 37 is added after loudspeaker 40 has been mounted.

It is anticipated that both plate 33 and cover 37 also can be formed of the above mentioned high density foam.

Figure 3:
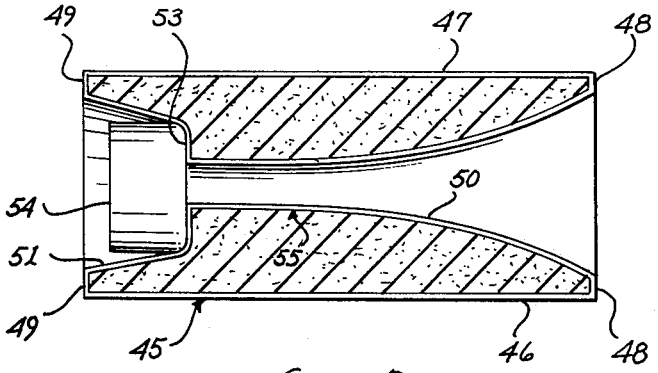
FIG. 3 illustrates the adaptability of the teachings of the present invention to accommodate high frequency drivers.

Referring to FIG. 3, there is shown a variant of the present invention particularly adapted for use in conjunction with self-contained high frequency drivers. Enclosure 45 includes lateral sides 46 and 47, front end 48 and rear end 49. A cavity, shaped by an envelope 55, extends through enclosure 45 and defines horn 50 and recess 51. Envelope 55 may be formed of molded fiberglass or similar material as described above. The space intermediate envelope 55 and the lateral sides and front and rear ends of enclosure 45 is filled with low density foam (i.e. two pound foam) and the foam maintains the envelope 55 positionally rigid within the enclosure.

Horn 50, though shown as an exponentially shaped horn, may be of different configuration, depending upon the acoustic qualities intended by the audio engineer. Recess 51 includes an annular base 53 surrounding the throat of horn 50, which base serves as the mounting platform for the high frequency driver 54. In accordance with accepted acoustic procedures, a seal is disposed intermediate the driver and the base to prevent communication therebetween. The configuration of most self-contained high frequency drivers in such that the resonant chamber is disposed within the structure of the driver itself. Hence, recess 51 need not be sealed by a plate as described above with respect to the structure shown in FIG. 1. However, should the high frequency driver not contain its own resonant chamber, a plate may be employed across the aperture of recess 51 at the rear ends 49.

Again, as described above, fiberglass techniques are especially adaptable to the formation of the structure defining envelope 55, that is, horn 50 and recess 51. Furthermore, vibration damping of horn 50 is effectively accomplished by the low density foam disposed adjacent the horn.

Figure 4:
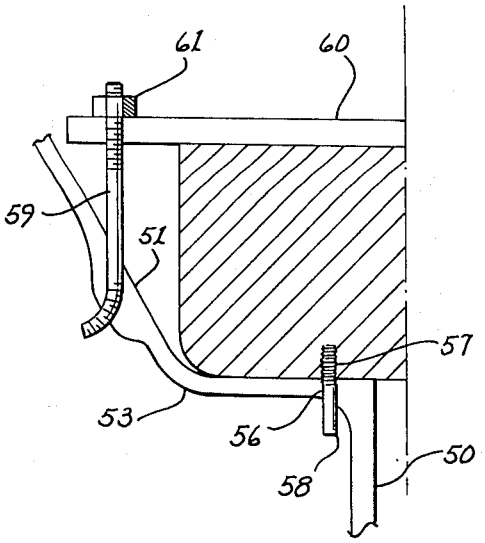
FIG. 4 illustrates a representative manner for mounting a high frequency driver within the enclosure shown in FIG. 3.

Referring briefly to FIG. 4, there is shown a partial sectional view of driver 54 and a means for mounting it within recess 51. Generally, high frequency self-contained drivers include diametrically opposed pairs of threaded cavities 57 in their front surface for receiving bolts for attaching the front surface of the driver to a mounting board. For purposes of the present invention, threaded studs 56 are inserted within the threaded cavities 57. These studs extend into mating depressions 58 within base 53. Thereby, driver 54 is centrally aligned with the throat of horn 50. The face of driver 54 is generally planar and readily mateable with the planar base 53 to establish as effective air seal therebetween. One or more pairs of threaded studs 59 are embedded within the foam lateral and rearward of base 53 and extend into recess 51 rearwardly of driver 54. An apertured plate 60 extends across the rear surface of driver 54 with the apertures thereof receiving the extending ends of studs 59. A nut 61 is threaded onto each stud penetrating plate 60 to draw the driver into firm engagement with base 53. It is to be understood that modifications and alterations of the above discussed mounting may be incorporated without departing from the teachings of the present invention.

Figure 5:
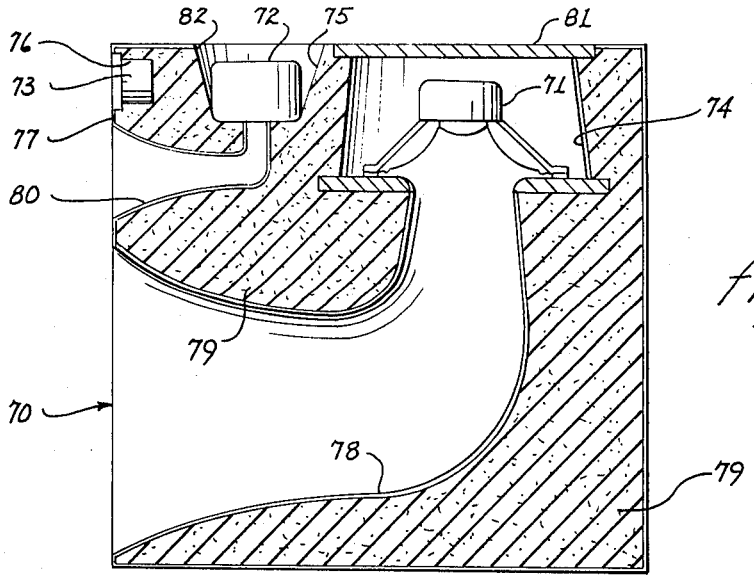
FIG. 5 illustrates the adaptability of the present invention for use in conjunction with multiple discrete range loudspeakers.

Referring to FIG. 5 there is shown a multiple speaker enclosure, such as might be used by an individual in his home. The enclosure includes a low frequency loudspeaker 71, a medium frequency loudspeaker 72 and a tweeter 73. The low frequency loudspeaker 71 is mounted within a recess 74, which recess may be similar to that shown in FIGS. 1 or 2. The medium frequency loudspeaker 72 is mounted within a recess 75, such as that shown in FIG. 3. Tweeter 73, being essentially self-contained is mounted within a recess 76, which recess is disposed in the front face 77 of enclosure 70.

A horn 78 transmits the acoustic energy from low frequency loudspeaker 71 through an aperture disposed within front face 77. The size and shape of horn 78 is dictated by the vertical and horizontal angle of dispersion, as determined by an audio engineer. The horn 78 may be constructed as a fiberglass module, as described above, and is supported within an envelope of foam 79. In the alternative, the horn may be formed by the foam itself if the latter is of the type which cures into a hard surface in proximity to the mold. Similarly, horn 80 transmits the acoustic energy from medium frequency loudspeaker 72 to an aperture disposed within the front face 77 of enclosure 70. Horn 80 may also be of fiberglass mounted within an envelope of foam 79 or may be part of the foam itself if the latter cures into a hard surface adjacent its mold.

Access to low frequency loudspeaker 71 is provided by means of a sealed but detachable cover 81. Access to the medium frequency loudspeaker 72 is provided by the open end 82 of recess 75. Tweeter 73 is detachably inserted into recess 76 and is removable therefrom for maintenance or replacement purposes.

The housing for enclosure 70 may be formed of wood, metal, fiberglass of high density foam, depending upon considerations of weight and economy. Alternatively, no additional material may be needed for the housing if foam 79 is of the type which cures into a hard surface adjacent the mold.

Figure 6:
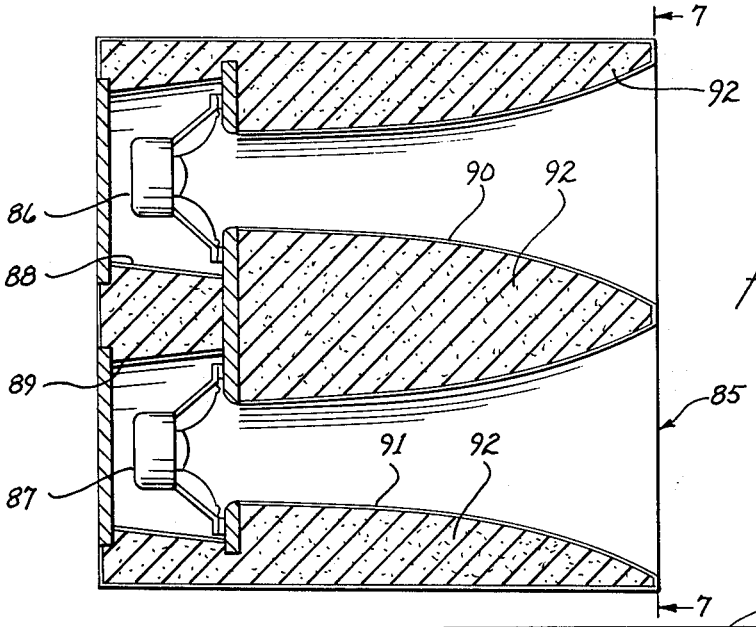
FIG. 6 illustrates an enclosure for housing a plurality of low frequency drivers dispersing acoustic energy through respective horns.
Figure 7:
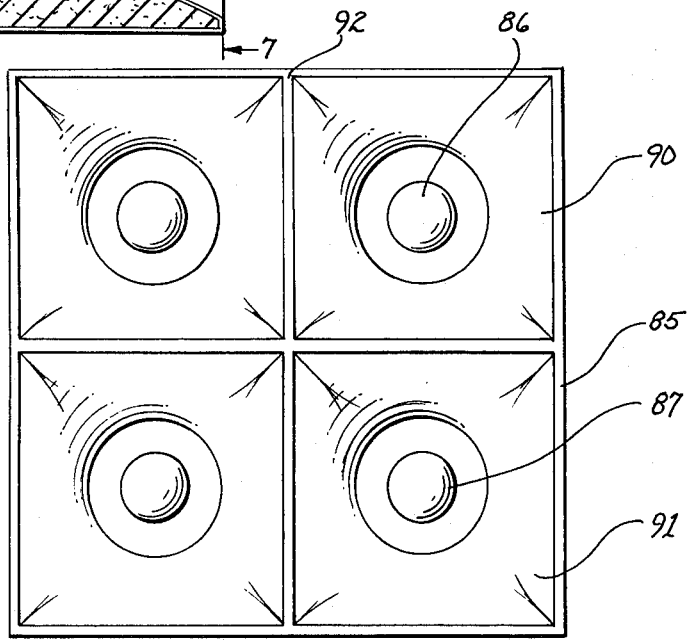
FIG. 7 is a frontal view of a speaker enclosure illustrated in FIG. 6.

Referring jointly to FIGS. 6 and 7 there is shown an embodiment of the present invention wherein a plurality of low frequency loudspeakers are mounted within the same enclosure 85. Although only two loudspeakers, 86 and 87, are illustrated in FIG. 6, it is to be understood that four or more loudspeakers may be used as well, as shown in FIG. 7. Each of the loudspeakers is mounted within its own recess (i.e. 88 and 89) in a manner as described above. A horn 90 and 91 is associated with loudspeakers 86 and 87 to accurately and with minimum distortion disperse the sound generated by the loudspeakers. Each of horns 90 and 91 are embedded within low density foam 92, which foam dampens vibration of the horn to minimize distortion. Moreover, the sympathetic induced vibration after attendant an array of horns is effectively dampened or eliminated. The configuration of each horn, as well as the orientation of its axis may be used to disperse the sound from each loudspeaker in a predetermined manner. The horns may each be formed of fiberglass modules or may be molded into the foam itself.

It may be appreciated that the present invention thusly permits multiple loudspeakers to be housed within a single enclosure 85 and yet as the components thereof are light in weight without being subject to self induced vibration, transportability is not impaired.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A loudspeaker cabinet having lateral sides and front and rear ends and including at least one loudspeaker disposed therein, said cabinet comprising in combination:

a. a recess disposed within said enclosure for circumscribing and supporting a loudspeaker;

b. a horn for transmitting the acoustic energy generated by the loudspeaker external to said cabinet and dispersing the acoustic energy within predetermined angles in the vertical and horizontal planes;

c. means for providing an air seal intermediate said recess and said horn within said cabinet; and d. means disposed adjacent said recess and said horn for supporting said recess and said horn in fixed spatial relationship to the lateral sides and front and rear ends of said cabinet and for damping acoustically generated vibration of said recess and said horn.

2. The cabinet as set forth in claim 1 wherein said supporting and damping means comprises synthetic foam.

3. The cabinet as set forth in claim 2 wherein the free air space within said cabinet is limited to the envelope defined by said recess and said horn.

4. The cabinet as set forth in claim 2 wherein said recess and said horn are defined by molded surfaces of said foam during the curing process of said foam.

5. The cabinet as set forth in claim 4 wherein the lateral sides and front and rear ends of said cabinet are defined by said foam and said cabinet comprises a monolithic unit.

6. The cabinet as set forth in claim 2 wherein said recess and said horn comprise individual elements.

7. The cabinet as set forth in claim 2 wherein said recess and said horn comprise a single module.

8. The cabinet as set forth in claim 1 including means disposed in proximity to said recess for receiving and supporting the loudspeaker.

9. The cabinet as set forth in claim 8 including cover means for sealing the loudspeaker within said recess.

10. The cabinet as set forth in claim 1 including a plurality of said recesses, each said recess supporting a single loudspeaker and further including a plurality of said horns, each said horn transmitting the acoustic energy of one of the loudspeakers external to said cabinet.

11. The cabinet as set forth in claim 11 wherein each of said plurality of horns is configured to primarily disperse a different frequency range of acoustic energy.

* * * * *